United States Patent [19]

Noda

[11] Patent Number: 4,734,553

[45] Date of Patent: Mar. 29, 1988

[54] COOKING APPARATUS CAPABLE OF DETECTING TEMPERATURE OF FOOD TO BE COOKED

[75] Inventor: Tomimitsu Noda, Nagoya, Japan

[73] Assignee: Kabushiki Kaisha Toshiba, Kawasaki, Japan

[21] Appl. No.: 942,370

[22] Filed: Dec. 16, 1986

[30] Foreign Application Priority Data

Dec. 27, 1985 [JP] Japan ..... 60-293119

[51] Int. Cl.[4] ..... H05B 1/02; H05B 6/68

[52] U.S. Cl. ..... 219/10.55 B; 219/506; 219/497; 219/505; 374/120; 374/129; 374/133; 99/325; 99/329 R; 250/338

[58] Field of Search ..... 219/10.55 B, 505, 492, 219/493, 330, 331, 497, 506, 501, 10.55 R; 250/341, 347, 351, 353, 338; 350/6.1, 6.5, 6.6; 374/121, 124, 129, 130, 131, 149, 133; 99/325, 329 R

[56] References Cited

U.S. PATENT DOCUMENTS

| | | | |
|---|---|---|---|
| 4,347,418 | 8/1982 | Nobue et al. | 219/10.55 B |
| 4,396,817 | 8/1983 | Eck et al. | 219/10.55 B |
| 4,461,941 | 7/1984 | Fokuda et al. | 219/10.55 B |
| 4,617,438 | 10/1986 | Nakata | 219/10.55 B |

FOREIGN PATENT DOCUMENTS

| | | | |
|---|---|---|---|
| 2951434 | 7/1980 | Fed. Rep. of Germany | 219/10.55 B |
| 60-28117 | 7/1985 | Japan . | |

*Primary Examiner*—M. H. Paschall

*Attorney, Agent, or Firm*—Oblon, Fisher, Spivak, McClelland & Maier

[57] ABSTRACT

A cooking apparatus determining a temperature of food to be cooked by detecting the changes in the intensity of the infrared rays from the food. The cooking apparatus includes an infrared ray detecting circuit having a detecting element which detects infrared rays from the food.

When the actual temperature change in the vicinity of the detecting element is more than a predetermined value, the detecting element is prevented from receiving the infrared rays from the food. The detecting element detects the actual temperature, and the infrared ray detecting circuit outputs the corresponding detection value. The detection value from the infrared ray detecting circuit is stored in a control circuit. The output of the infrared ray detecting circuit is corrected by the stored detection value when the detecting element is exposed to the infrared rays from the food.in order to carry out a precise temperature detection for the food.

13 Claims, 7 Drawing Figures

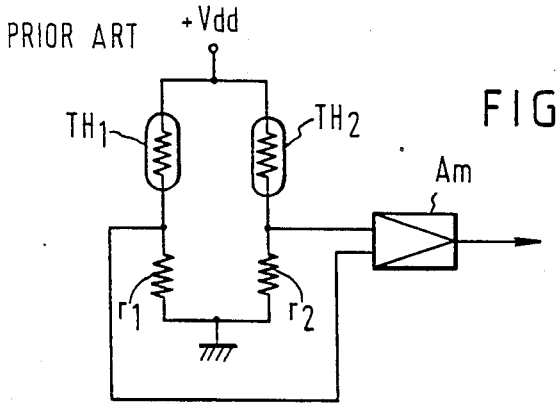
FIG. 1.
FIG. 2.
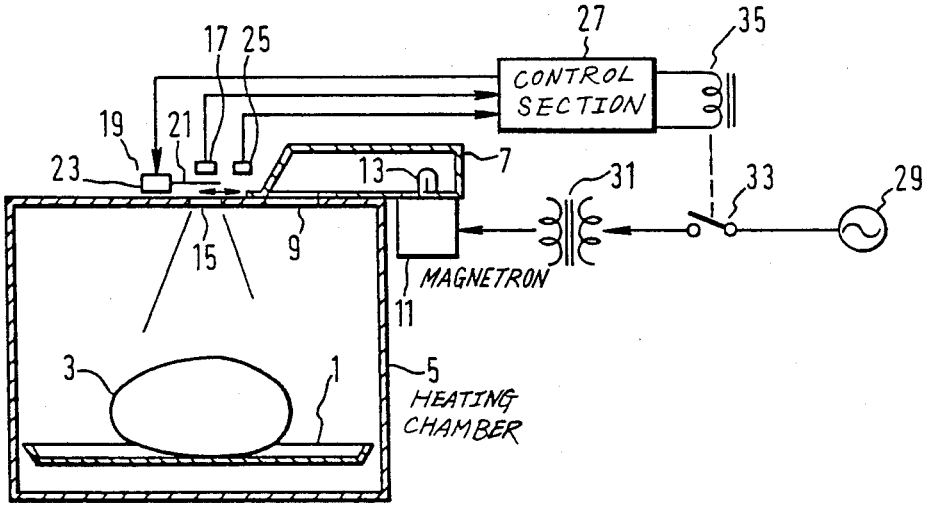

COOKING APPARATUS CAPABLE OF DETECTING TEMPERATURE OF FOOD TO BE COOKED

BACKGROUND OF THE INVENTION

1. Field of the Invention

The present invention relates, in general, to electric cooking apparatus. More specifically, the invention relates to a cooking apparatus in which a cooking completion is determined by detecting the infrared rays from food to be cooked.

2. Description of the Prior Art

Generally, it is difficult to determine whether cooking is completed or not in the cooking operation, because it depends largely on a cook's intuition and experience. Recently, in electric cooking apparatus, such as, e.g., microwave ovens, automatic cooking has been provided. The temperature of food to be cooked is detected by a thermistor whose resistance value varies in response to the changes of the wave-length of the infrared rays radiated from the food.

The output of the thermistor representing the temperature of the food is compared with a predetermined temperature value, and the cooking completion is thereby determined.

An example of the above-described microwave oven is disclosed in Japanese patent application No. 54-31485 (Patent publication No. 28117/1985) filed Mar. 16, 1979, and entitled HIGH FREQUENCY HEATING APPARATUS. In this prior art, a thermistor is used as the infrared ray detection element. Infrared rays radiated from the food are intermittently supplied to the thermistor by the operation of a chopper. The resistance value of the thermistor varies in response to the changes of the wave-length of the infrared rays, and an AC signal is obtained as an output of the thermistor. Based on this AC signal, the temperature of the food can be determined.

According to the above-described prior art, automatic cooking may be carried out. However, in this prior art, since the changes of terminal voltage of the thermistor are small, it is difficult to accurately detect the temperature of food to be cooked on the basis of only the output signal of the thermistor. Therefore, it is necessary to use, as shown in the prior art, a chopper mechanism, a chopper temperature detection circuit and a photocoupler for detecting the on-off timing of the chopper mechanism. Furthermore, since thermistors have, in general, a thermal time constant, the output level (AC signal) of the thermistor is low, and this low output level often causes errors in the detection under the influence of foreign noise.

As shown in FIG. 1, elimination of these components, e.g., chopper, photocoupler, etc., from the prior art circuit, was considerd.

In FIG. 1, a first thermistor Th1 and a second thermistor Th2 are used for detecting temperatures. First thermistor Th1 receives infrared rays from the food to detect the temperature of the food. Second thermistor Th2 does not receive the infrared rays from food, but detects the actual temperature in the atmosphere surrounding these thermistors Th1 and Th2. First thermistor Th1 is grounded through a resistor r1, and second thermistor Th2 also is grounded through a resistor r2. A DC voltage (+Vdd) is supplied to the first and second thermistors Th1 and Th2. The outputs from the connecting points between first thermistor Th1 and resistor r1, and second thermistor Th2 and resistor r2, are input to amplifying circuit Am. A difference value between the output of first and second thermistors Th1 and Th2 is output from amplifying circuit Am. Therefore, the temperature of the food is determined on the basis of the difference value.

In the construction described above, however, since the properties of thermistors Th1 and Th2 generally differ from one another, errors may be included in the detected temperature. Therefore, the result of the cooking is not uniform. On the other hand, if thermistors having the same properties are used, the cost increases.

SUMMARY OF THE INVENTION

It is an object of the invention to provide an improved cooking apparatus which may accurately detect the temperature of food to be cooked without being affected by the property differences between temperature detecting elements.

The cooking apparatus according to the present invention accomplishes this object. It comprises a detecting device including a first thermistor for detecting the infrared rays from food to be cooked. The detecting device generates a first heat signal having a first data corresponding to the temperature of the food, and a second data corresponding to the actual temperature in the vicinity of the detecting device when the detecting device receives infrared rays from the food, and generates a second heat signal including the second data when the detecting device receives no infrared rays from the food. The cooking apparatus further comprises a temperature detecting circuit for detecting the actual temperature changes in the vicinity of the detecting device, and a shutter device which is activated when the actual temperature change is more than a predetermined value. The shutter device comprises a shutter element and a solenoid device for blocking the passage of infrared rays from the food to the thermistor of the detecting device when the shutter device is activated, and for exposing the thermistor of the detecting device to infrared rays from the food when the shutter device is deactivated. The cooking apparatus further includes a control circuit comprising a bridge circuit for storing a value representitive of the second data in the second heat signal from the detecting device when the detecting device receives no infrared rays from the food, and for subtracting the stored second data value from the first heat signal of the detecting device when the detecting device receives infrared rays from the food. This operation causes the control circuit to generate a temperature signal including the first data which corresponds to the temperature of the food.

The control circuit includes a determining circuit for determining a temperature of the food on the basis of the temperature signal. The cooking apparatus may include a cooking completion circuit for controlling the cooking completion of the food by comparing the determined temperature of the food with a predetermined cooking completion temperature.

BRIEF DESCRIPTION OF THE DRAWINGS

The present invention is best understood with reference to accompanying drawings in which;

FIG. 1 is a circuit diagram of a prior art;

FIG. 2 is a schematic view illustrating a construction of one embodiment of the present invention;

DETAILED DESCRIPTION OF THE PREFERRED EMBODIMENTS

Figure 3:
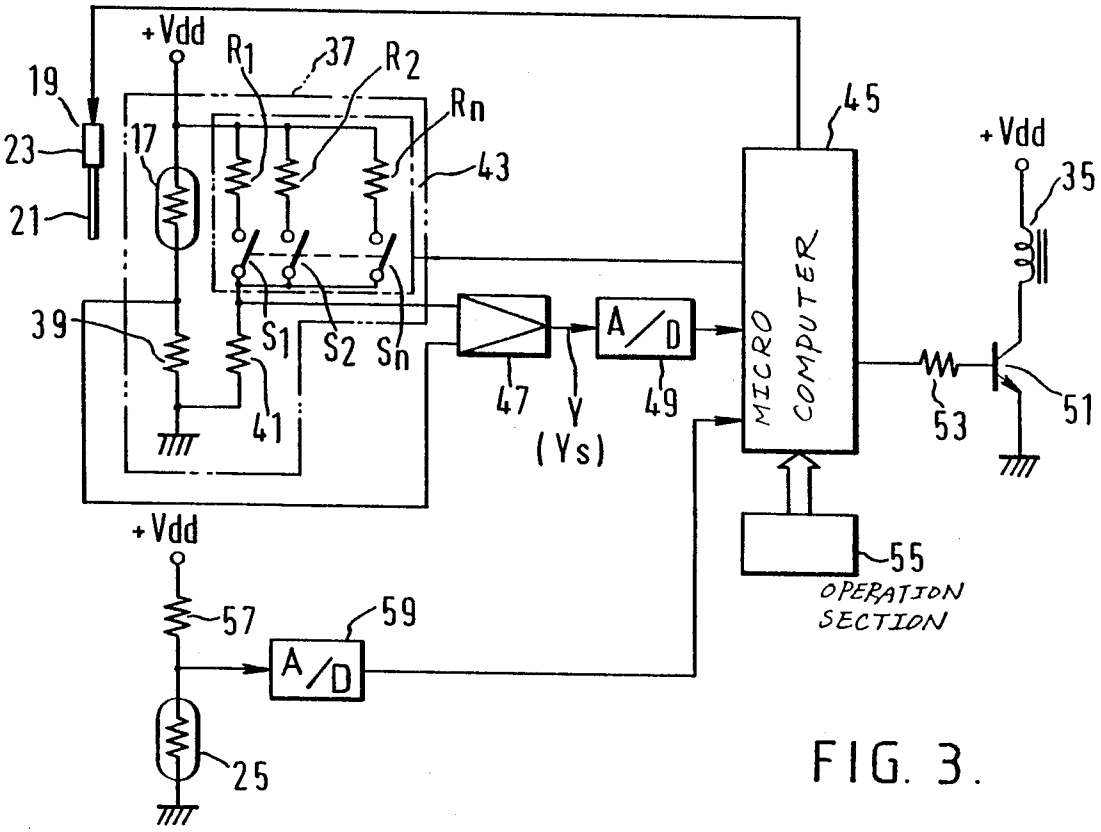
FIG. 3 is a circuit diagram of one embodiment shown in FIG. 2.

The preferred embodiments of the present invention will now be described in more detail with reference to the accompanying drawings. In FIG. 2, a tray 1 with food 3 is arranged is provided in a heating chamber 5. A wave-guide 7 is mounted on heating chamber 5. One end of wave-guide 7 is communicated with the interior of heating chamber 5 through a supply opening 9 which is provided to the upper surface of heating chamber 5. A magnetron device 11 is attached to the other end of wave-guide 7, and an antenna 13 of magnetron device 11 is positioned inside wave-guide 7. The microwaves generated by magnetron device 11 are fed from antenna 13 into heating chamber 5 through wave-guide 7 and supply opening 9.

An infrared ray permeable opening 15 is provided in the center portion of the upper surface of heating chamber 5. A first thermistor 17 is arranged above infrared ray permeable opening 15 to act as a temperature detecting element. Thus, first thermistor 17 can receive infrared rays radiated from food 3 through infrared ray permeable opening 15. A shutter device 19 including a shutter 21 and a solenoid 23 is arranged on the upper surface of heating chamber 5.

Shutter 21 permits first thermistor 17 to receive the infrared rays from food 3 in heating chamber 5 through infrared ray permeable opening 15 while solenoid 23 of shutter device 19 is deactivated. On the other hand, when solenoid 23 of shutter device 19 is activated, shutter 21 driven by solenoid 23 is moved into the position between first thermistor 17 and infrared ray permeable opening 15 to prevent first thermistor 17 from receiving the infrared ray from food 3 through infrared ray permeable opening 15.

A second thermistor 25 is provided in the vicinity of first thermistor 17 to act as a temperature detecting element. Second thermistor 25, however, does not receive any infrared rays from food 3 in heating chamber 5 through infrared ray permeable opening 15, but it detects only the actual temperature where first and second thermistors 17 and 25 are situated.

First and second thermistors 21 and 25 and solenoid 23 of shutter device 19 are individually connected to a control section 27, described hereafter. Magnetron device 11 is connected to AC commercial voltage supply 29 through a high voltage transformer 31 and a relay switch 33. Relay switch 33 is controlled by control section 27 through a relay 35.

In FIG. 3, an infrared ray detecting circuit 37 is composed of thermistor 17, resistors 39 and 41 and a resistor-switch arrangement 43 which are formed in a bridge formation. One end of thermistor 17 is connected to a DC voltage supply (+Vdd) and the other end thereof is grounded through resistor 39. One end of resistor-switch arrangement 43 is connected to one end of thermistor 17 and the other end is grounded through resistor 41.

As can be seen in FIG. 3, resistor-switch arrangement 43 includes a plurality of resistors R1, R2, . . . , and Rn and a plurality of switches S1, S2, . . . , and Sn whose number is the same as that of the resistor. Each resistor is serially connected to a corresponding switch. Therefore, resistors R1, R2, . . . , and Rn are selectively grounded through corresponding switches S1, S2, . . . , and Sn and resistor 41 in response to an output of a microcomputer 45, as described after.

The connecting point between resistor-switch arrangement 43 and resistor 41 is connected to one of the input terminals of an amplifier 47. Also, the connecting point between thermistor 17 and resistor 39 is connected to the other terminal of amplifier 47. The output of amplifier 47 is input to microcomputer 45 through an A/D (analogue/digital) convertor 49. Therefore, the output (analogue signal) of infrared ray detecting circuit 37 through amplifier 47 is converted into a digital signal by A/D convertor 49, and is fed to microcomputer 45 as cooking temperature data.

Microcomputer 45 has a first output supplied to resistor-switch arrangement 43, as described above. A second output is fed to the base of an NPN type transistor 51 through a resistor 53, and a third output is supplied to solenoid 23 of shutter device 19 to drive shutter 21. The collector of transistor 51 is connected to DC voltage supply (+Vdd) through relay 35, and the emitter thereof is grounded. The output from operation section 55 is input into microcomputer 45. A user, therefore, may input the desired cooking data into microcomputer 45 through operation section 55, such as, e.g., an operation panel.

As shown in FIG. 3, one end of thermistor 25 is connected to DC voltage supply (+Vdd) through a resistor 57 and the other end thereof is grounded. A voltage produced at the connecting point between thermistor 25 and resistor 57 is input into microcomputer 45 through an A/D convertor 59. Therefore, the output of thermistor 25 is converted into a digital signal, and is then fed into microcomputer 45 an actual temperature data.

The operation of the construction described above will be disclosed hereinafter. As shown in FIG. 2, the user puts food 3 on tray 1 in heating chamber 5, and closes the door (not shown) of heating chamber 5.

The user, furthermore, sets a cooking completion temperature of food 3 into microcomputer 45 through control section 55, and then operates a start-key (not shown).

Generally, since a plurality of cooking completion temperatures corresponding to the different kinds of cooking are previously stored in the memory of microcomputer 45, the user may only select a desired type of food from a variety of foods displayed on the panel (not shown).

Figure 5:
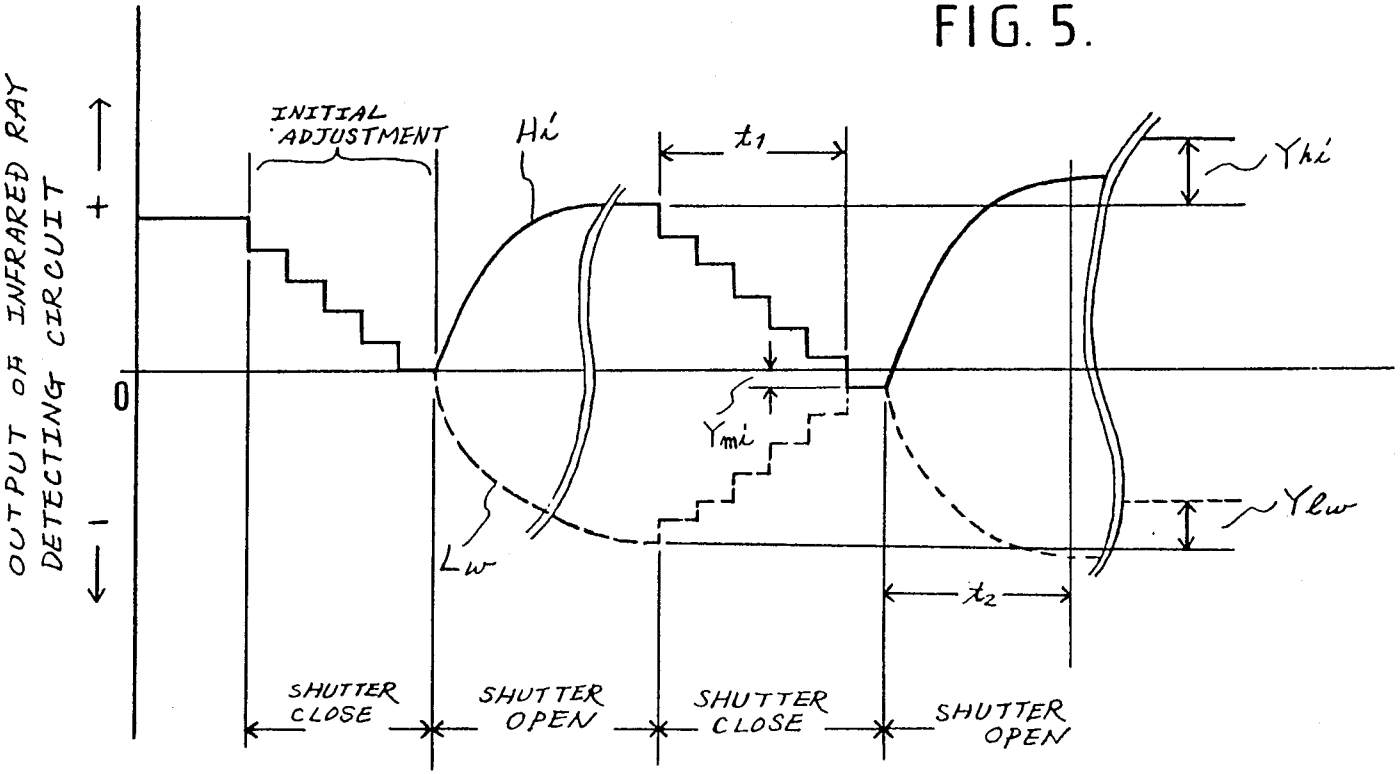
FIG. 5 is a graph showing an output change of an infrared ray detecting circuit shown in FIG. 3.

In response to the operation of the start-key, the initial adjustment of the output of infared ray detecting circuit 37 is executed, as shown in FIG. 5.

Firstly, shutter 21 is closed by microcomputer 45, and output Y of infrared ray detecting circuit 37 is adjusted to zero by the operation of resistor-switch arrangement 43.

The initial adjustment is completed when the output of the bridge circuit of infrared ray detecting circuit 37 balances. Furthermore, the actual temperature detected by thermistor 25 is sent to microcomputer 45, and stored into the memory of microcomputer 45. A detailed operation of the zero adjustment will be described later.

Simultaneously, in response to the operation of the start-key, transistor 51 is turned on by microcomputer 45, and then relay switch 33 is closed by relay 35.

Magnetron 11 is energized by AC voltage supply 29 through relay switch 33 and high voltage transformer 31, and microwaves are radiated from antenna 13 of magnetron 11.

The microwaves from antenna 13 are fed into heating chamber 5 through wave-guide 7 and supply opening 9, and food 3 on tray 1 is cooked by the dielectric heating.

During cooking, infrared rays energy W is radiated from food 3. The infrared ray energy W is calculated from the following Equation (1) which is well known as the Stefan-Boltzmann law.

$$W=\eta\times\sigma\times Tf^4 \quad (1)$$

where $\eta$ is the emissivity of a material (e.g. food to be cooked and shutter), $\sigma$ is Stefan-Boltzmann constant, and Tf is the absolute temperature of food.

As can be understood in FIG. 2, an infrared ray radiated from food 3 is received by thermistor 17 through infrared ray permeable opening 15. Since thermistor 17 is heated by the radiation heat of the infrared ray from food 3, the resistance value thereof changes in response to the changes of the infrared ray from food 3.

Therefore, the output of infrared ray detecting circuit 37 also changes. As described above, the output of infrared ray detecting circuit 37 amplified by amplifier 47 is converted into a digital signal by A/D convertor 49, and supplied to microcomputer 45 as cooking data. It should be noted that, for convenience sake, the output Y of amplifier 47 is hereinafter referred to as the output of infrared ray detecting circuit 37.

In this arrangement, the resistance value changes of thermistor 17 occur under the influence of the radiation heat of the infrared rays from food 3 as well as the actual temperature. Therefore, if the actual temperature change is large, the resistance value of thermistor 17 changes greatly even if the changes in the intensity of the infrared rays from food 3 are small.

Accordingly, if the actual temperature change is large, it is necessary to regulate the resistance value of thermistor 17.

Figure 4:
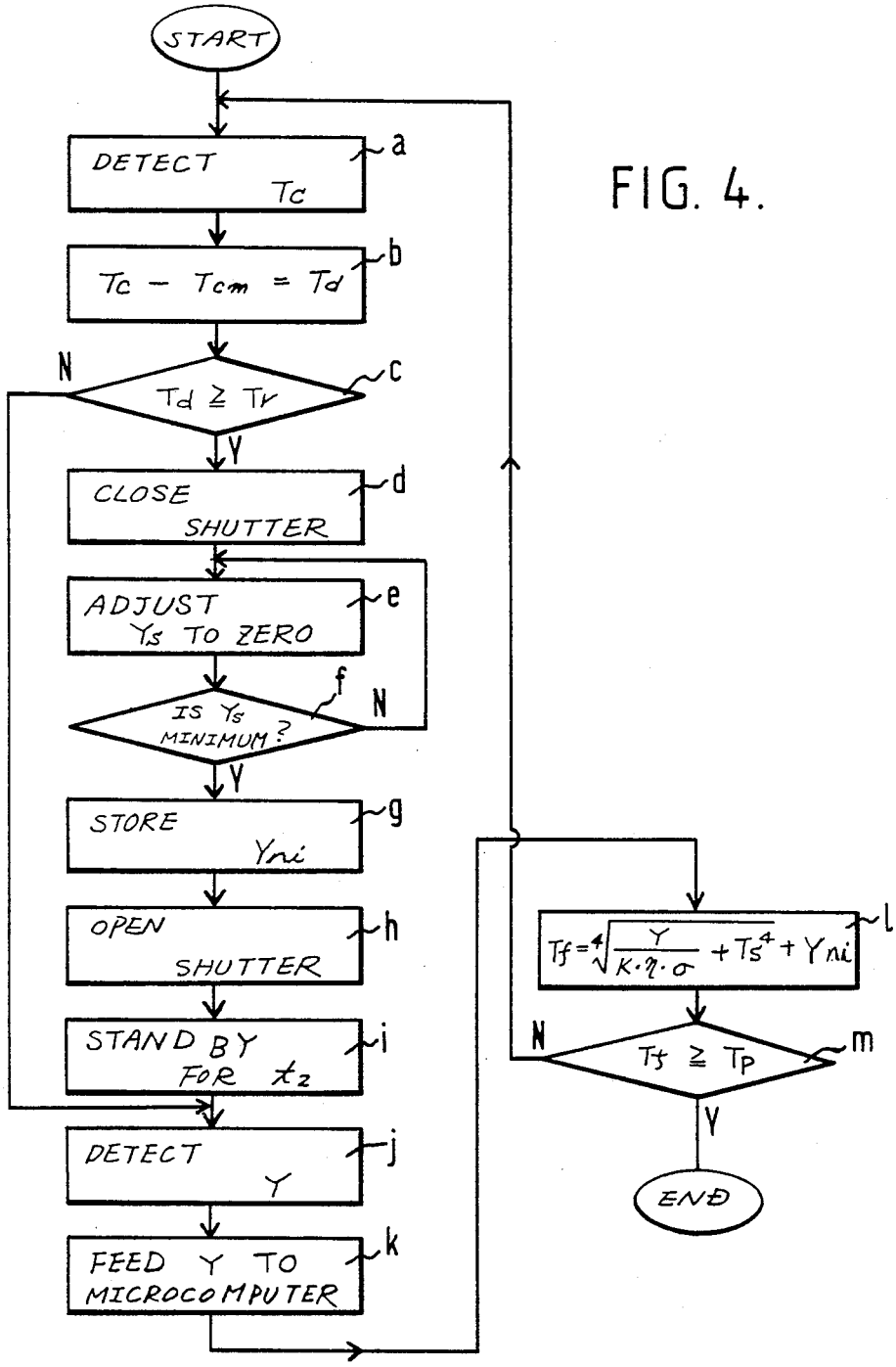
FIG. 4 is a flow chart showing a temperature determining operation of the food to be cooked in one embodiment.

The temperature detecting operation of this embodiment will be described with reference to the flow chart shown in FIG. 4.

The actual temperature is detected by thermistor 25, and the corresponding temperature data Tc is fed to microcomputer 45 through A/D convertor 59 (step a). Microcomputer 45 compares the latest actual temperature data Tc from thermistor 25 with the former temperature data Tcm.

The output Y of infrared ray detecting circuit 37 was adjusted to zero following detection of temperature Tcm. Microcomputer 45 calculates the difference Td between these two temperatures Tc and Tcm (step b). The former temperature Tcm has been stored in the memory of microcomputer 45. In the decision step c, if the difference Td is more than a predetermined value Tr, the YES-path is taken. Otherwise, the NO-path is taken. The temperature Tcm stored in the memory of microcomputer 45 is converted to the actual temperature data Tc, if the YES-path is taken. In step d, microcomputer 45 activates shutter 21 through solenoid 23, and shutter 21 is moved between thermistor 17 and infrared ray permeable opening 15. Under this state, the resistance value of thermistor 17 is changed by only the wave-length of the infrared rays from shutter 21, because shutter 21 prevents thermistor 17 from receiving the infrared rays from food 3.

Therefore, the output Ys of infrared ray detecting circuit 37 corresponds to the difference between the present temperature of shutter 21 and the former temperature of shutter 21 at which the output Ys of infrared ray detecting circuit 37 was adjusted to zero. In other words, since it can be considered that the temperature of shutter 21 is substantially equal to the actual temperature, the output Ys of infrared ray detecting circuit 37 corresponds to the amount of the temperature change between the latest actual temperature detected by thermistor 25 and the former temperature, at which the output Ys of infrared ray detecting circuit 37 was adjusted to zero.

In steps e and f, in order to adjust the output Ys of infrared ray detecting circuit 37 to zero, microcomputer 45 selectively controls the plurality of switches (S1, S2, . . . , Sn) on and off, as shown in FIG. 3. Thus the corresponding resistors (R1, R2, . . . , Rn) are selectively connected to the bridge circuit of infrared ray detecting circuit 37 (the time period t1 shown in FIG. 5). When the output of the bridge circuit is balanced, the output Ys of infrared ray detecting circuit 37 may be adjusted to zero. In other words, the resistance value of thermistor 17 corresponding to the actual temperature in the vicinity of thermistor 17 is stored as the resistance value of the connected resistor of the bridge circuit. However, in case that the output Ys of infrared ray detecting circuit 37 cannot be adjusted to zero, microcomputer 45 stores the minimum value of the output Ys of infrared ray detecting circuit 37 into its memory as a compensation value Ymi (step g).

After that, microcomputer 45 allows shutter 21 to be moved by solenoid 23 from the position between thermistor 17 and infrared ray permeable opening 15 (step h). Therefore, thermistor 17 again receives the infrared ray from food 3. Microcomputer 45, however, does not accept the output Y from infrared ray detecting circuit 37 for a prescribed period of time t2, as shown in FIG. 5, until the output Y from infrared ray detecting circuit 37 becomes stable (step i).

After the period of time t2, microcomputer 45 receives the output Y from infrared ray detecting circuit 37 (steps j and k). At this time, the output Y of infrared ray detecting circuit 37 may include only the data corresponding to the temperature of food 3. This is because the stored resistance value of thermistor 17 corresponding to the actual temperature is automatically subtracted through the bridge circuit from the resistance value of thermister 17 which corresponds to the temperatures of the food 3 and actual temperature.

In the graph of FIG. 5, output Y of infrared ray detecting circuit 37 is indicated by a solid curved line Hi when the temperature of food 3 is higher than that of shutter 21. Otherwise, output Y of infrared ray detecting circuit 37 is indicated by a dashed curved line Lw when the temperature of food 3 is lower than that of shutter 21 (thawing operation).

Since the emissivity of shutter 21 is substantially equal to that of food 3, the output of infrared ray detecting circuit 37 is expressed by the following Equation (2) on the basis of the above-described Equation (1):

$$Y = K \times \eta \times \sigma \times (Tf^4 - Ts^4) \quad (2)$$

where K is a constant determined by a detecting circuit, and Ts is absolute temperature of shutter 21.

Accordingly, the temperature Tf of food 3 is expressed by the following Equation (3):

$$Tf = \sqrt[4]{\frac{Y}{K \times \eta \times \sigma} + Ts^4} \quad (3)$$

In step 1, microcomputer 45 computes the food temperature Tf by using Equation (3). If the compensation value Ymi has been stored in the memory of microcomputer 45, the compensation for the food temperature Tf calculated by microcomputer 45 is carried out. After that, in step m, the calculated food temperature Tf is compared with a predetermined cooking completion temperature Tp. When the food temperature Tf is less than the predetermined cooking completion temperature Tp, the No-path is taken, and the above-described steps are re-executed sequentially.

On the other hand, when the food temperature Tf is more than the predetermined cooking completion temperature Tp, microcomputer 45 allows relay switch 33 to be opened by relay 35. Then, magnetron device 11 stops its oscillating action, and the cooking operation is completed. As shown in FIG. 5, the output increase amount Yhi or Ylw of infrared ray detecting circuit 37 from the initial output thereof corresponds to the temperature rise of food 3 by the cooking operation.

Figure 6:
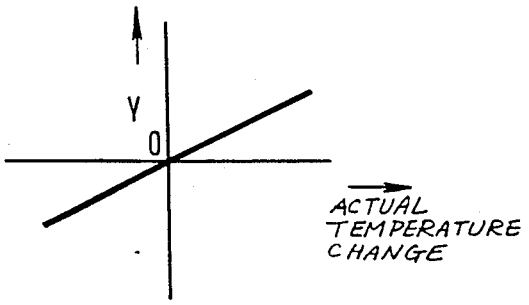
FIG. 6 is a graph showing a relationship between the output of the infrared ray detecting circuit and an actual temperature.

The output changes of infrared ray detecting circuit 37 also are caused by the temperature character of thermistor 17 in response to the actual temperature change. No zero-adjusting operation for the output Y of infrared ray detecting circuit 37 is carried out when the actual temperature change is small. However, since this output change data of infrared ray detecting circuit 37, as shown in FIG. 6, is previously stored in the memory of microcomputer 45, the compensating operation for the output of infrared ray detecting circuit 37 may be carried out in the usual way on the basis of the stored data when the actual temperature change exceeds a predetermined level.

According to the above-described embodiment, since the zero-adjusting operation for the infrared ray detecting circuit is carried out every time at which the actual temperature change exceeds a predetermined level, an exact temperature detection for food to be cooked may be carried out without being affected by the property difference between thermistors 17 and 25. Furthermore, since no chopper-operation is needed in this embodiment, a high output level of a thermistor may be obtained, and thus precise temperature detection for food is carried out without influence from foreign noise.

Figure 7:
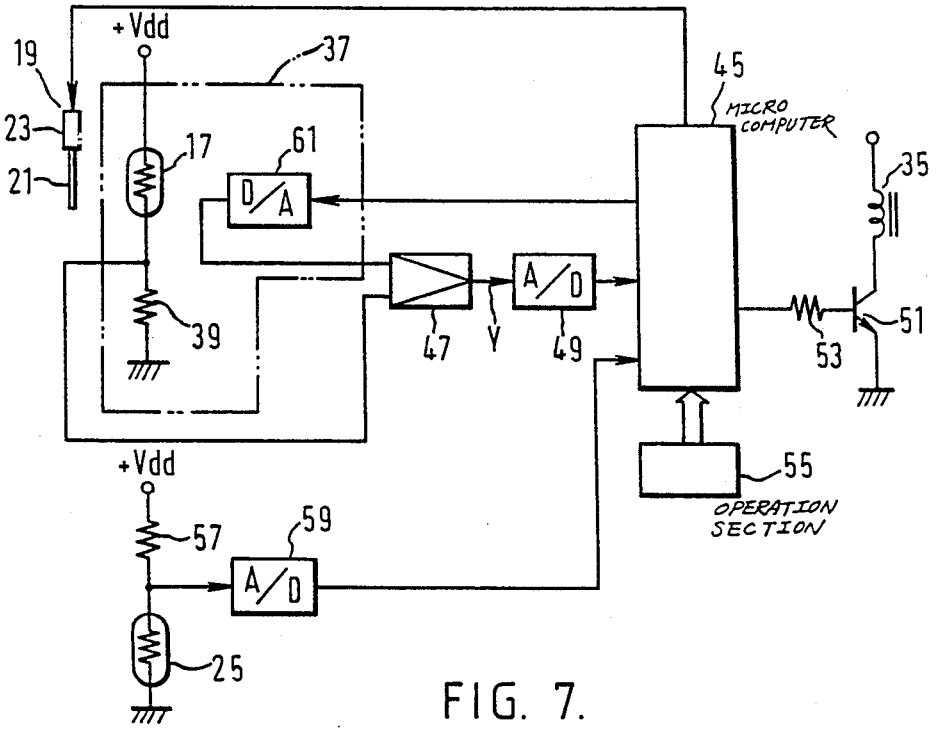
FIG. 7 is a circuit diagram of another embodiment of the present invention.

Another embodiment of the present invention will be described with reference to FIG. 7. In this embodiment, a D/A (digital/analogue) converter 61 is used in infrared ray detecting circuit 37 instead of resistor-switch arrangement 43. The input of D/A converter 61 is connected to microcomputer 45, the output of which is connected to one of the input terminals of amplifier 47. The voltage difference between the voltage produced at the connecting point between thermistor 17 and resistor 39 and the output of D/A converter 61 is amplified by amplifier 47, and fed to microcomputer 45 through A/D converter 49. In this embodiment, since the zero-adjusting operation for the output Y of infrared ray detecting circuit 37 may be carried out, no compensation for the food temperature calculated by the microcomputer is needed.

The present invention has been described with respect to specific embodiments. However, other embodiments based on the principles of the present invention should be obvious to those of ordinary skill in the art. Such embodiments are intended to be covered by the claims.

What is claimed is:

1. A cooking apparatus, for controlling a cooking operation in response to the temperature of food to be cooked, comprising:

means for detecting infrared rays from the food, including a generating means for generating a first heat signal having first and second components when the infrared detecting means receives infrared rays from the food, said first component corresponding to the temperature of the food and said second component corresponding to the actual temperature in the vicinity of the infrared detecting means, and for generating a second heat signal having only the second component when the infrared detecting means receives no infrared rays from the food;

temperature detecting means for detecting the actual temperature change in the vicinity of the infrared detecting means;

shutter means for blocking the passage of infrared rays from the food to the infrared detecting means when the actual temperature change detected by the temperature detecting means exceeds a predetermined value;

control means responsive to the shutter means and the infrared detecting means, for storing a value representative of the second component in the second heat signal from the infrared detecting means when the infrared detecting means receives no infrared rays from the food, and for substracting the stored second component value from the first heat signal of the infrared detecting means when the infrared detecting means receives infrared rays from the food for generating a temperature signal including the first component and corresponding to the temperature of the food.

2. An apparatus according to claim 1, wherein the shutter means includes a shutter element and a solenoid device for driving the shutter element.

3. An apparatus according to claim 1, wherein the control means includes means for determining the cooking temperature of the food on the basis of the temperature signal.

4. An apparatus according to claim 3, wherein the control means further includes cooking completion means for comparing the determined temperature of the food with a predetermined cooking completion temperature for controlling the cooking completion of the food when the infrared detecting means receives infrared rays from the food.

5. An apparatus according to claim 1, wherein the temperature detecting means includes thermistor means for varying the resistance value in response to the actual temperature.

6. An apparatus according to claim 5, wherein the control means stores temperature data detected by the thermistor means of the temperature detecting means and the temperature detecting means further includes means for comparing the latest actual temperature data detected by the thermistor means with the former temperature data which the control means has stored.

7. An apparatus according to claim 1, wherein the infrared detecting means includes a thermistor means for varying the resistance value in response to changes of infrared rays from the food and the actual temperature in the vicinity of the infrared detecting means.

8. An apparatus according to claim 7, wherein the control means further includes a bridge circuit, the thermistor means of the infrared detecting means being a part of the bridge circuit.

9. An apparatus according to claim 8, wherein the control means includes a plurality of resistors, the plurality of resistors also being a part of the bridge circuit.

10. An apparatus according to claim 9, wherein the control means further includes means for selectively connecting the plurality of resistors to the bridge circuit, and adjusting the output of the bridge circuit to substantially zero for storing the second component value of the second heat signal when the control means receives the second heat signal from the infrared detecting means.

11. An apparatus according to claim 7, wherein the control means includes a resistor connected in series with the thermistor means at a connecting point, and means for outputting a variable voltage.

12. An apparatus according to claim 11, wherein the control means further includes means for balancing the voltage at the connecting point between the thermistor means and the resistor with the output voltage of the outputting means for storing the second component value of the second heat signal when the control means receives the second heat signal from the infrared detecting means.

13. A cooking apparatus comprising:

means for providing microwaves to food to be cooked;

means for detecting infrared rays from the food, including outputting means for outputting a first detection result including a first component corresponding to the temperature of the food and a second component corresponding to the actual temperature in the vicinity of the infrared detecting means when the infrared detecting means receives infrared rays from the food, and for outputting a second detection result including the second component when the infrared detecting means receives no infrared rays from the food;

temperature detecting means for detecting the actual temperature change in the vicinity of the infrared detecting means;

a shutter device for operating only when the actual temperature change detected by the temperature detecting means is more than a predetermined value, including means for preventing the infrared detecting means from receiving the infrared rays from the food when the shutter device is activated, and means for exposing the infrared detecting means to the infrared rays from the food when the shutter device is deactivated; and a control device responsive to the shutter device and the infrared detecting means, including means for storing the second component of the second detection result from the infrared detecting means when the infrared detecting means receives no infrared rays from the food, means for subtracting the stored second component from the first detection result of the infrared detecting means for generating a temperature signal having the first component corresponding to the temperature of the food when the infrared detecting means receives infrared rays from the food, means for determining the temperature of the food from the temperature signal, and cooking completion means for comparing the determined temperature of the food with a predetermined cooking completion temperature for controlling the cooking completion.

* * * * *